United States Patent [19]

Sauder

[11] 4,177,036

[45] Dec. 4, 1979

[54] HIGH TEMPERATURE INDUSTRIAL FURNACE

[75] Inventor: Robert A. Sauder, Emporia, Kans.

[73] Assignee: Sauder Industries, Inc., Emporia, Kans.

[21] Appl. No.: 830,612

[22] Filed: Sep. 6, 1977

Related U.S. Application Data

[63] Continuation-in-part of Ser. No. 694,562, Jun. 10, 1976, abandoned.

[51] Int. Cl.[2] ..... F27D 1/00

[52] U.S. Cl. ..... 432/247; 110/336; 432/251

[58] Field of Search ..... 432/247, 251; 156/324; 110/336

[56] References Cited

U.S. PATENT DOCUMENTS

| | | | |
|---|---|---|---|
| 1,573,188 | 2/1926 | Parker | 110/336 |
| 3,012,923 | 12/1961 | Slayter | 156/30 |
| 3,113,001 | 12/1963 | Weber | 29/191.6 |
| 3,281,306 | 10/1966 | D'Asto | 161/162 |
| 3,298,150 | 1/1967 | Ahlquist | 52/506 |
| 3,639,276 | 2/1972 | Mueller | 252/62 |
| 3,819,468 | 6/1974 | Sauder et al. | 161/152 |
| 3,832,815 | 9/1974 | Balaz et al. | 110/336 |
| 3,892,396 | 7/1975 | Monaghan | 110/336 X |
| 3,930,916 | 1/1976 | Shelley | 156/71 |
| 3,940,244 | 2/1976 | Sauder et al. | 432/247 |

*Primary Examiner*—John J. Camby
*Attorney, Agent, or Firm*—Arnold, White & Durkee

[57] ABSTRACT

A high temperature industrial furnace comprising a clean interior face of a metal furnace casing, a corrosion inhibitor/adhesive, and a ceramic fiber insulation module attached to the casing with the adhesive to provide an elastic or flexible bond between the casing and the insulation material is disclosed. The corrosion inhibitor-/adhesive may be applied over a relatively large surface area of the casing to provide a vapor impervious membrane. A silicone compound is a preferred corrosion inhibitor/adhesive material.

20 Claims, 13 Drawing Figures

FIG.1
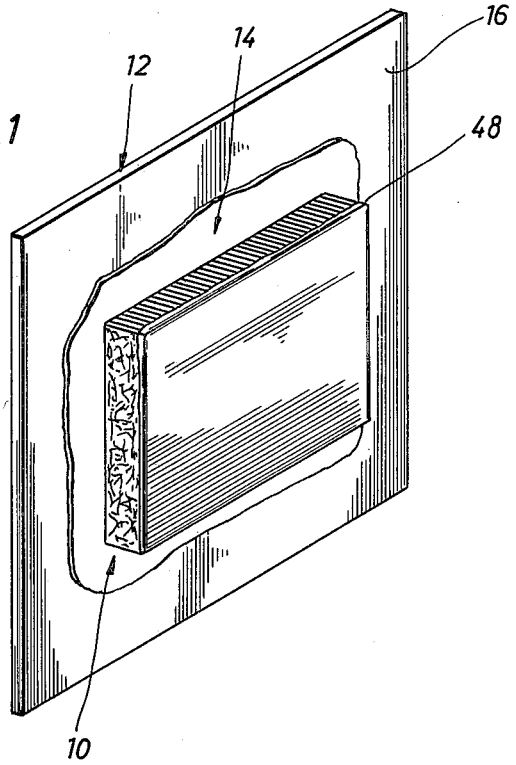
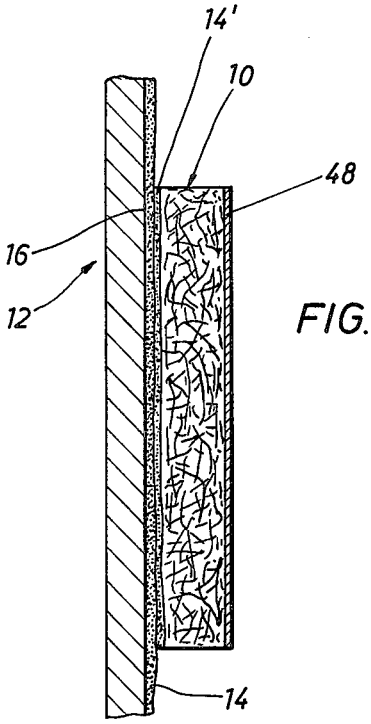
FIG.2
FIG.3
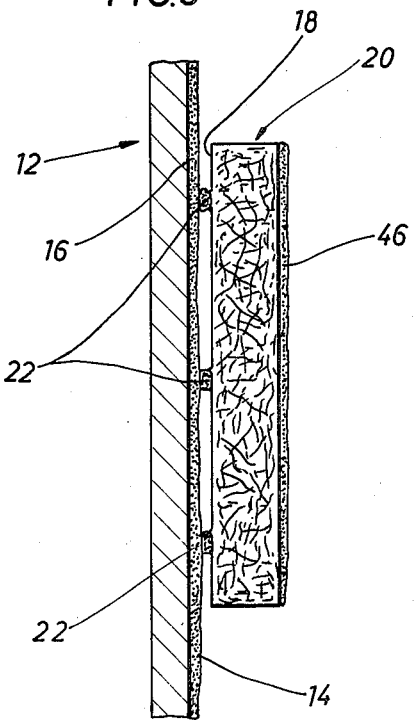
FIG.4
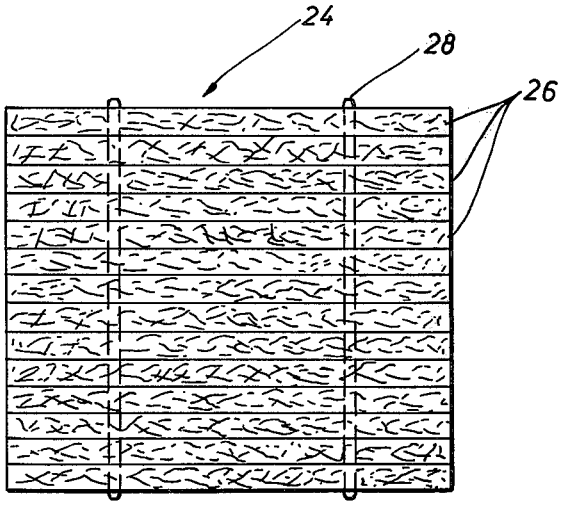

FIG.5
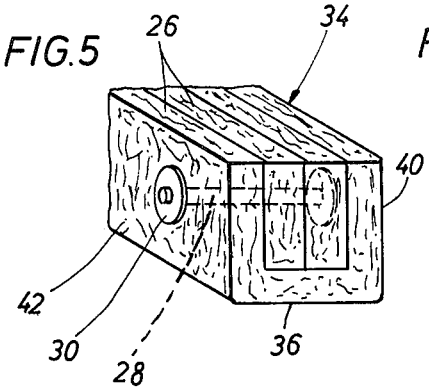
FIG.6
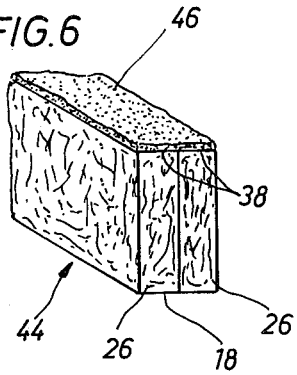
FIG.7
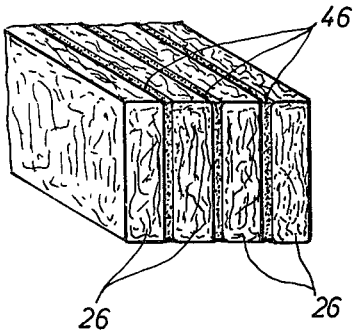
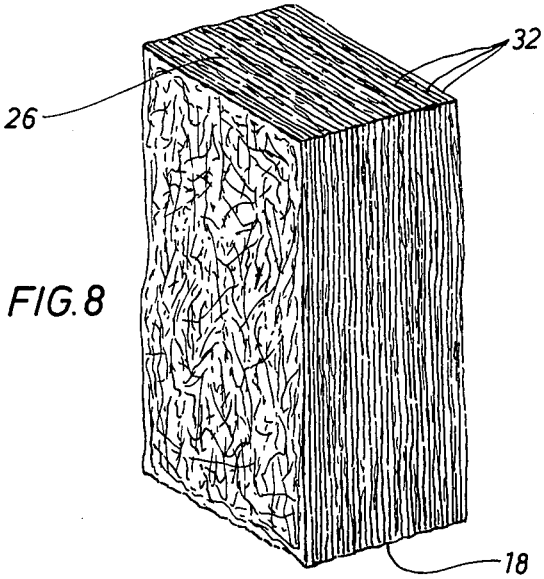
FIG.8
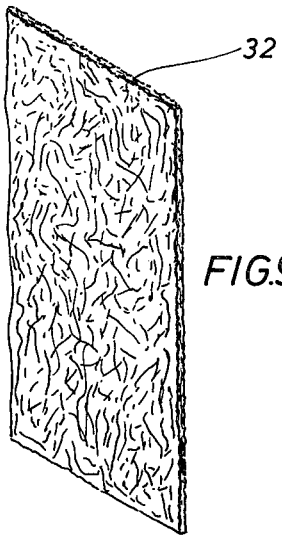
FIG.9
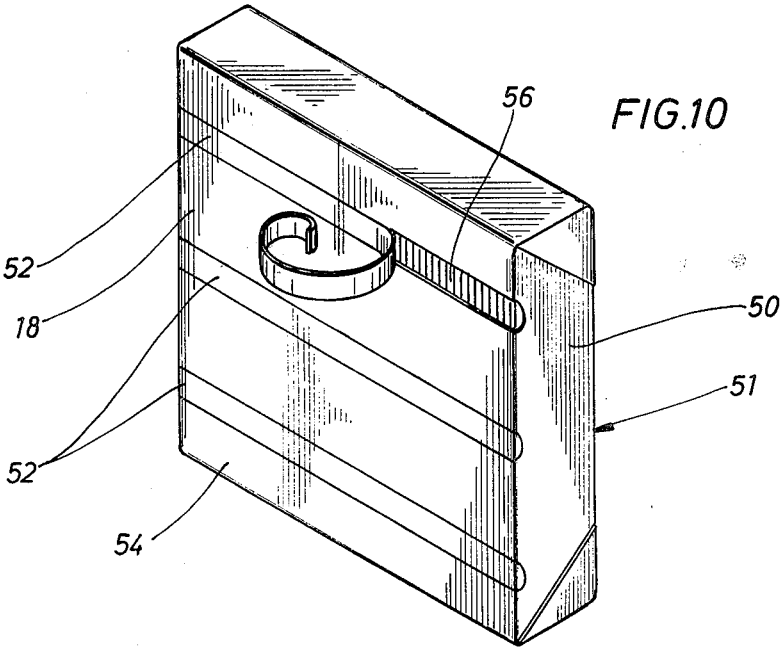
FIG.10

HIGH TEMPERATURE INDUSTRIAL FURNACE

BACKGROUND OF THE INVENTION

This is a continuation in-part application of U.S. application Ser. No. 694,562 filed June 10, 1976 for "ADHESIVE METHOD OF LINING A FURNACE" now abandoned.

The present invention relates generally to a novel high temperature industrial furnace with an insulation material adhesively fastened to the interior chamber thereof. More particularly, the present invention involves the use of a corrosion inhibiting/adhesive material to bond a ceramic fiber insulation module to a metallic furnace wall.

In the past, it has been known to fasten a high temperature ceramic fiber insulation module to the interior chamber wall of an industrial furnace capable of developing temperatures in excess of 2300° F. Fasteners in the form of bolts or studs have been affixed, for example by welding, to the interior chamber wall, and insulating modules have been impaled on these projections and fastened into place.

More recently, a system has been developed which enables an insulation module to be selectively positioned on a chamber wall and then affixed thereto by means of a stud which is welded to the chamber wall. See, for example, Sauder et al, U.S. Pat. No. 3,819,468 assigned to Sauder Industries, Inc., wherein such a system is disclosed. Such prior art systems are satisfactory or highly desirable in some installations.

However, in circumstances where the interior geometry of a high temperature chamber is complex or where the furnace chamber is going to be exposed to highly corrosive gases, it has been found that known systems and apparatus have performed less than ideally. For example, in highly corrosive atmospheres, it is common to experience a corrosive action on the metallic fastening hardware and/or the interior chamber wall itself. Whereas the ceramic fibers of the insulation material exposed to such a chemically hostile environment remain substantially unaffected, the fastening hardware may deteriorate to such an extent that the structural integrity of the insulation layer and the furnace casing is threatened.

Particular problems have been noted in instances where sulphur containing gases have been generated in furnace chambers and have penetrated the ceramic insulation material into the cooler regions of the furnace. In these cooler regions, usually along the surface of the cold face of the insulation material, these sulphur containing gases may condense along with some water vapor to produce a relatively strong concentration of sulphuric acid on the metal chamber wall and around the fastening hardware. The effects of sulphuric acid on metal are well-known, and it is a relatively short time before insulation fastening hardware and/or chamber walls will experience great damage.

In instances where furnace chambers have unusual geometries, e.g., assymetric with many curved surfaces, or in instances where obstructions e.g., pipes or tubing, impeded the attachment of insulating material to the chamber wall, known techniques have proven to be awkward and, in some cases, may require a substantial expenditure in time and labor in excess of that which is economically feasible.

In the past it has been known to veneer the interior of a brick or ceramic furnace with ceramic fiber insulating materials which are attached to the interior walls thereof. For example, a refractory mortar may be used to affect a ceramic-to-ceramic bond between, say fire brick and a ceramic fiber insulating material.

Many of these mortars are air-setting and become glass-like or brittle in their properties. These mortars or adhesive materials tend to crack in instances where one of the adherent surfaces experiences significant thermal growth or shrinkage. Moreover, these ceramic mortars and the like may be porous and enable corrosive vapors to penetrate through the mortars or through the cracks formed from thermal movement of the casing. These vapors permit the formation of highly corrosive acids and the like along the interior face of the casing.

Recognizing the need for an improved system for applying insulating material to the interior chamber of a furnace, it would, therefore, be desirable to provide an improved high temperature industrial furnace which may be constructed easily and which also inhibits the undesirable effects of a corrosive atmosphere on the casing wall.

OBJECTS AND SUMMARY OF A PREFERRED EMBODIMENT OF THE INVENTION

It is, therefore, a general object of the present invention to provide a novel furnace which minimizes or reduces the problems of the type previously noted.

It is a more particular object of the present invention to provide a novel construction of a furnace which prevents or at least inhibits the action or corrosive vapors on the chamber walls of a furnace.

It is another object of the present invention to provide a novel furnace the construction of which eliminates the necessity of using of metal fasteners to attach an insulating material to a chamber wall in the furnace.

It is yet another object of the present invention to provide a novel and relatively easily constructed furnace which may have casing walls having unusual curvatures or geometries.

It is still another object of the present invention to provide a novel furnace which may be relatively easily constructed in the presence of obstructions between the casing wall and the interior of the furnace.

It is yet still another object of the present invention to provide a novel furnace which provides for the anaerobic isolation of the interior casing walls by providing a vapor impervious membrane therefor.

It is a further object of the present invention to provide a novel furnace which accommodates thermal growth and shrinkage of the casing wall without damage to the components of the insulation system.

A high temperature industrial furnace according to a preferred embodiment of the invention intended to substantially accomplish the foregoing objects includes an interior metal wall of a furnace chamber which has been cleaned and which presents a substantially unoxidized surface to the interior chamber. A corrosion inhibitor is then applied to the now clean interior wall and prior to any substantial oxidation having taken place on the wall. This corrosion inhibitor includes an adhesive which when brought into contact with the corrosion inhibitor applied to another material will bond the items together.

Preferably, corrosion inhibitor is applied to a cold face of an edge-grained ceramic fiber insulating material. The insulating material is then pressed against the now coated chamber wall. The corrosion inhibitor is cured in air at ambient temperature to yieldingly bond the ceramic fiber insulating material to the metal chamber wall.

This arrangement provides for a slight stretching of the corrosion inhibitor resulting from thermal growth of the interior wall when the furnace casing is heated to temperatures in the order of 300° F. or so and for a slight shrinking when the temperature is returned to ambient.

Examples of the more important features of this invention have thus been given rather broadly in order that the detailed description thereof that follows may be better understood, and in order that the contribution to the art may be better appreciated. There are, of course, additional features of the invention that will be described hereinafter and which may also form the subject of the claims appended hereto.

Other objects, features and advantages of the present invention will become apparent with reference to the following detailed description of a preferred embodiment thereof in connection with the accompanying drawings wherein like reference numerals have been applied to the elements, in which:

BRIEF DESCRIPTION OF THE DRAWINGS

FIG. 1 schematically depicts a ceramic fiber insulating module which has been adhesively attached to a metal furnace chamber wall;

FIG. 2 is a partial cross-sectional view of the arrangement shown in FIG. 1;

FIG. 3 is a partial cross-sectional view depicting an alternative arrangement to that shown in FIG. 2;

FIG. 4 is a plan view of a ceramic insulating module assembled for use in accordance with the present invention;

FIG. 5 is a schematic representation of a ceramic fiber insulating module suitable for use in the practice of the present invention;

FIG. 6 is a schematic representation of an alternative arrangement for a ceramic fiber insulating module for use in practicing the present invention;

FIG. 7 is a pictorial representation of a yet further alternative embodiment of a ceramic fiber insulating module for use in practicing the present invention;

FIG. 8 is a detailed pictorial representation of one of the strips or portions thereof of the ceramic fiber insulating material comprising the insulating modules depicted in FIGS. 1 through 7;

FIG. 9 pictorially represents a layer of ceramic fiber insulating material which comprises a strip such as that depicted in FIG. 8;

FIG. 10 pictorially represents another alternative arrangement for a ceramic fiber insulating module for use in practicing the present invention;

DETAILED DESCRIPTION OF A PREFERRED EMBODIMENT OF THE INVENTION

Figure 11:
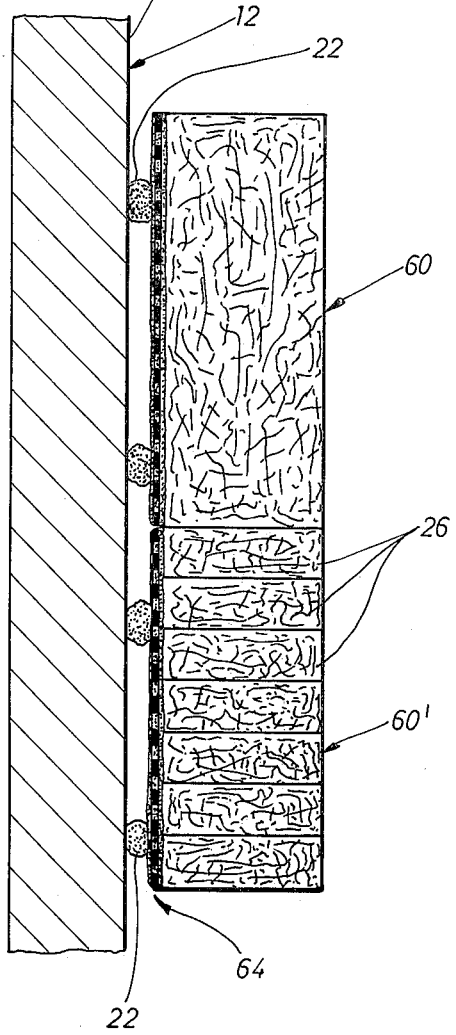
FIG. 11 is a partial cross-sectional view depicting two adjacent insulating modules in another embodiment of the present invention.
Figure 12:
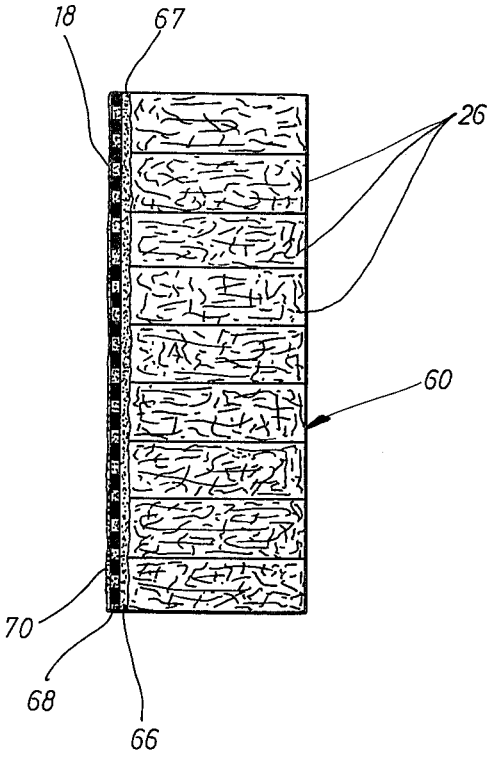
FIG. 12 is a partial cross-sectional view of one of the modules in FIG. 11.

As may be seen in FIGS. 1 and 2, the present invention relates to a construction of a high temperature industrial furnace wherein a ceramic fiber insulating module 10 is adhesively attached to a furnace wall 12. Whereas the present invention will have application in many types of furnaces having a variety of structural components, the embodiments described herein will be particularly useful in instances where the furnace chamber wall is comprised of metal, for example steel.

In the case of a newly manufactured furnace, this steel will most likely be already relatively free from contaminants or oxidants. However, in the case of a furnace which has been in operation for, say, several years, the interior wall of the furnace chamber will most likely be covered with some form of insulation, or the remnants thereof, and a wide variety of ash, carbon, and other oxidants.

In order to achieve a satisfactory bond according to the present invention, it is desirable first to clean the furnace wall to remove extraneous matter which may impede the adhesion and corrosion inhibiting characteristics of the bonding material as will be hereinafter more fully described. This cleaning may be accomplished by sandblasting techniques or acid treatment techniques which are well-known in the art. In any event, it will be understood that in preferred form, the interior metal wall will be cleaned to expose an unoxidized metal surface.

Onto this cleaned metal surface there will be applied a corrosion inhibitor/adhesive 14 which will effectively seal the interior surface 16 of the wall 12 against corrosive action resulting from oxidation, or action by an acidic corrosive environment. Preferably the interior surface 16 of the furnace casing 12 will be anaerobically isolated from the interior of the furnace chamber as a result of a vapor impervious membrane formed by this corrosion inhibitor/adhesive 14. This corrosion inhibiting/adhesive material may take various forms in the practice of this invention. In preferred form, this material will demonstrate several important characteristics.

This material 14 should be capable of withstanding temperatures of 300° F. or more at the interior surface 16 or "cold face" of the insulation module 10; should demonstrate certain elastic characteristics to accommodate thermal growth and thermal shrinkage of the furnace casing 12; and, in addition, should demonstrate certain adhesive characteristics which will be hereinafter more fully described. It is important in the practice of the present invention that this corrosion inhibiting/adhesive material 14 demonstrate these characteristics.

For example, in many instances, the "cold face" of an insulating material will experience temperatures in the 200° to 300° F. range, and it is essential that the corrosion inhibiting material not break down at these high temperatures. Moreover, many metal objects, particularly sheets or plates of metal, will experience minor geometric changes as these objects pass from ambient temperatures to temperatures in the range of 200° F. to 300° F. This geometric transformation may be referred to as "thermal growth" or "thermal shrinkage" which refer to increases and decreases in geometric dimensions respectively.

In the case of prior art devices, the thermal growth of a furnace wall might be sufficient to cause a ceramic coating to crack. Ceramic or glass-like structures by their very nature demonstrate highly limited stretching or shrinking characteristics and therefore have proven to be unacceptable in many cases. For example, if the interior of a furnace having such a ceramic coating were to become filled with a gas such as hydrogen sulfide and thermal growth were to occur to cause such ceramic material to crack, this hydrogen sulfide gas could permeate through cracks in the insulating material and into the cold region of the insulation whereupon the gas could condense along with any water vapor in the furnace. The combination of the water vapor condensate and the hydrogen sulfide condensate may form an acid highly corrosive to metal surfaces.

The cracking of the ceramic coating material may provide an access to the actual metal surface itself and enable a corrosive action to begin. Once a corrosive action begins in a zone of a wall, it could continue over a much larger zone behind the ceramic coating without there appearing to be any outward sign on the furnace wall until such corrosion became so widespread that the furnace wall would be virtually decomposed.

An important feature of the present invention is the adhesive characteristics of the corrosion inhibiting material 14 which is applied to the furnace wall. A highly desirable feature of the present invention resides in the fact that a corrosion inhibitor/adhesive 14 used on the wall may also be applied at 14' to the cold face 18 of a module 10 of ceramic insulation prior to attachment of the module to the furnace wall.

As may be seen in FIG. 2, this corrosion inhibiting-/adhesive material 14 on the furnace casing 12 and on the module 10 may be brought into contact, and slight pressure may be applied to the "hot face" of the module to urge the module against the interior face 16 of the furnace casing 12. This results in a bonding of the insulation module 10 in a position overlying the wall. That is, the material 14 is applied to the furnace interior face 16 and also to the ceramic insulating module 10 which enables the ceramic insulation to be positioned anywhere the material 14 can be applied. Preferably, the material 14 used both for inhibiting corrosion of the furnace wall and for bonding the ceramic insulating module 10 to the wall is a room temperature valcanizing silicone compound identified by the Trademark SILASTIC, type "732 RTV" available from Dow Corning Corporation, Midland, Mich., U.S.A., which has been diluted with any one of a group of well-known solvents.

It will, of course, be appreciated that the module may be constructed from a series of side-by-side ceramic fiber strips held together by a paper covering 48 or the like as shown in FIGS. 1 and 2. With such an arrangement, the entire cold face of the module would be coated with a corrosion inhibitor/adhesive prior to attachment of the module to a furnace wall. This corrosion inhibitor/adhesive would serve to give the module structural integrity in its operational environment and obviate the necessity of utilizing wires or pins or other metallic apparatus for assembling the module. Such an arrangement would be particularly advantageous in environments where high levels of corrosive vapors are anticipated. That is, even though a stainless steel wire may be utilized in modules attached to a furnace wall in accordance with the present invention, there will be instances of unusually hostile environments where such metallic devices may be less desirable than an arrangement depicted in FIGS. 1 and 2.

In some instances it may be desirable to apply a corrosion inhibiting/adhesive material 14 to the module in a manner shown in FIG. 3. Rather than cover an entire cold face 18 of an insulating module 20, strips 22 of corrosion inhibiting/adhesive material 14 may be applied either to the cold face 18 of the insulation module 20 or to the already coated metal furnace casing 12. It will, of course, be appreciated that in furnace chambers where no corrosive gases are present or are anticipated, the ceramic fiber insulation material 20 may be applied directly to the interior face 16 of the metal furnace casing 12 by means of strips 22 of corrosion inhibiting-/adhesive material 14. In addition, the ceramic fiber insulation 10, 20 may be applied to an uncoated furnace casing 12 by applying a layer of corrosion inhibiting-/adhesive material 14 to the cold face 18 of the insulating material and urging the same against the surface 16 of the furnace casing. This latter procedure will result in a corrosion inhibitor layer being applied to the metal casing; however, such a layer may have slight gaps between modules unless care is exercised to assure that the material 14' is uniformly applied over the entire cold face 18 of the module.

A wide variety of ceramic insulating materials may be utilized in the practice of this invention. However, in preferred form, a ceramic fiber insulating bat of the types shown in FIGS. 4 through 7 and 10 are preferred.

In FIG. 4 there may be seen an insulating module 24 comprised of a series of side-by-side insulating strips 26 which have been fastened together with a set of wires or pins 28 which run transverse to the large faces of each of the strips. The wire or pins 28 may be held in place by a washer or some similar button-like structure 30 (see FIG. 5). Thread made from textile or synthetic material may be utilized in place of the wire or pins 28 in instances where structural support is not required after the installation according to the present invention.

Each insulating strip 26 is comprised of insulating fibers, preferably of the ceramic type. The fibers have no particular orientation but form a plurality of planes 32 substantially parallel to each other and generally perpendicular to the cold face or flat side 18 of each module (see FIGS. 8 and 9).

Referring now to FIG. 5, it can be seen that a ceramic fiber insulation module 34, shown only in part in FIG. 5, may be constructed with a series of side-by-side interior members 26 and at least one generally U-shaped outer member 36, a surface of which defines the hot face 38 of the module 34, and two ends 40, 42 of which define edges of the module 34. This module 34 may be held together with pins or wires or threads 26 which pass through a washer or button 30 as described above. However, it will be appreciated that a wire made, for example, of stainless steel, may be bent at 90° at each end and without the presence of a button 30 in order to provide a suitable terminus for such a fastening arrangement.

In FIG. 6, there may be seen another module 44 which may be attached to a furnace wall in accordance with the present invention. This module 44, shown only in part in FIG. 6, comprises a series of side-by-side ceramic strips 26 as in the case of the module 24 depicted in FIG. 4. The module 44 may be attached to the furnace casing 12 in the manner described above in connection with FIG. 3. The module 4 (or 20) is held together prior to attachment to the wall by a temporary cement 46, preferably of an organic type, along the hot face 38 of the module.

With this arrangement, a module 44 may be coated along its cold face 18 with a corrosion inhibitor/adhesive material 14 as described above, applied to a clean surface on the furnace casing 12 and permitted to cure in place. When the furnace is fired to ordinary operating temperatures, the temporary cement 46 will burn off eliminating the support that was provided thereby. However, the support is no longer needed along the hot face of the module inasmuch as the corrosion inhibiting-/adhesive material along the cold face will provide the module with adequate structural integrity during operation.

The temporary cement 46 provides a particularly advantageous arrangement inasmuch as the surface provided by the layer of temporary cement is relatively rigid and may be pushed upon by a person performing the present method in order to urge the cold face (coated with corrosion inhibitor/adhesive) against the furnace casing.

During handling of the module 44 in constructing a furnace in accordance with the present invention, the interfiber forces will be sufficient to hold the strips in a substantially side-by-side arrangement. In instances where relatively large modules are fashioned from a series of side-by-side strips with temporary cement along the hot face portion, it may be desirable to introduce a wire or thread along a portion nearer the cold face in order to provide additional structural integrity during the installation process.

With reference now to FIG. 7, another module 45 suitable for use in connection with the present invention is depicted. A series of side-by-side ceramic insulating strips 26 may be cemented together along their lateral edges with the same kind of temporary cement 46 described above in connection with FIG. 6. Such a module may be applied according to the present invention, and when the furnace is fired to operating temperatures, the temporary cement in the lateral interstices will burn off. However, inasmuch as the ceramic insulating material will tend to grow slightly upon being heated, the fiber will expand into the zone created by the burned-away cement. In order to assure that the vacancies created by the burned away temporary cement are occupied by ceramic fiber material, the module may be compressed slightly during fabrication and held in such slightly compressed state by a paper lining or wrapper 48 (see FIGS. 1 and 2) which will hold the module in this compressed condition throughout the attachment process of the present invention. When the furnace is fired, not only would the cement in the lateral interstices be burned away, but also the paper would be burned away enabling the ceramic fiber to expand into the interstices.

There may be some instances, particularly in relatively low temperature, noncorrosive atmosphere furnaces, where a ceramic fiber insulating module of the type depicted in FIGS. 1 and 2 may be applied directly to a furnace wall by utilizing strips 22 of corrosion inhibitor/adhesive in a manner similar to that depicted in FIG. 3. That is, a ceramic fiber insulating module may be fabricated from a series of side-by-side strips 26 which are then slightly compressed and held in such a condition by a wrapper 50 such as disclosed in FIG. 10. With this module arrangement 51, a series of side-by-side ceramic fiber insulating strips are enclosed in a paper wrapper 50 having a plurality of tear strips 52 along one face 54. This face will become the cold face of the module. The side-by-side strips are compressed slightly prior to being wrapped in the paper 50.

When it is desired to attach a module to a furnace wall according to the present invention, the strips may be torn away to expose several areas 56 which run transverse the individual strips which comprise the module. The corrosion inhibitor/adhesive may be applied over these areas, and the module may be attached to the furnace casing in a manner hereinabove described. That is, the module may be attached to a layer of corrosion inhibitor/adhesive 14 already applied to the furnace casing (see FIG. 3), or the module may be attached directly to the interior surface of the wall without an additional coating of corrosion inhibitor-/adhesive. When the corrosion inhibitor/adhesive has had an opportunity to cure, the furnace may be fired. When the furnace is fired, the paper wrapping will be burned off at relatively low temperatures, and the compression in the ceramic fiber insulating strips will be relieved thus enabling the strips to expand slightly, particularly in the vicinity of the hot face. In this manner, any gaps in the insulating material will be covered as a result of this expansion action.

Moreover, a person constructing a furnace utilizing an insulation module 51 depicted in FIG. 10 and in accordance with the present invention, will not have to pay as close attention to positioning of the modules so long as adjacent modules are within reasonably proximity of each other since the modules will expand to cover any gaps resulting from nonadjacent installation. It will of course, be appreciated that the corrosion inhibitor-/adhesive which is applied to the areas 56 uncovered by the torn away paper strips 52 will now serve to hold together the individual side-by-side ceramic insulating strips 26 which comprise each module 51.

FIG. 11 depicts a pair of modules 60 and 60′ as they might lie in relationship to one another in a furnace constructed in accordance with the present invention. Modules 60 and 60′ are approximately the same size and each is comprised of a series of side-by-side insulating strips 26. The strips 26 are held in position with respect to one another by a substrate 64. The substrate 64 defines the cold face of the modules 60 and 60′ as will hereinafter be more fully explained.

It is preferable to construct the furnace of the present invention with adjacent modules rotated 90° with respect to the orientation of the strips 26. For example, in FIG. 11 it can be seen that module 60 has strips which run in a direction generally 90° with respect to the strips 26 of module 60′.

The substrate 64 is preferably comprised of three layers. An inside layer 66 is preferably comprised of corrosion inhibitor/adhesive 14 which has been diluted with any well-known solvent. This first layer 66 is applied to a plane or face 67 defined by edges of strips 26. The inhibitor/adhesive is applied in sufficient quantity to penetrate slightly into the ceramic fibrous material of strips 26.

Figure 13:
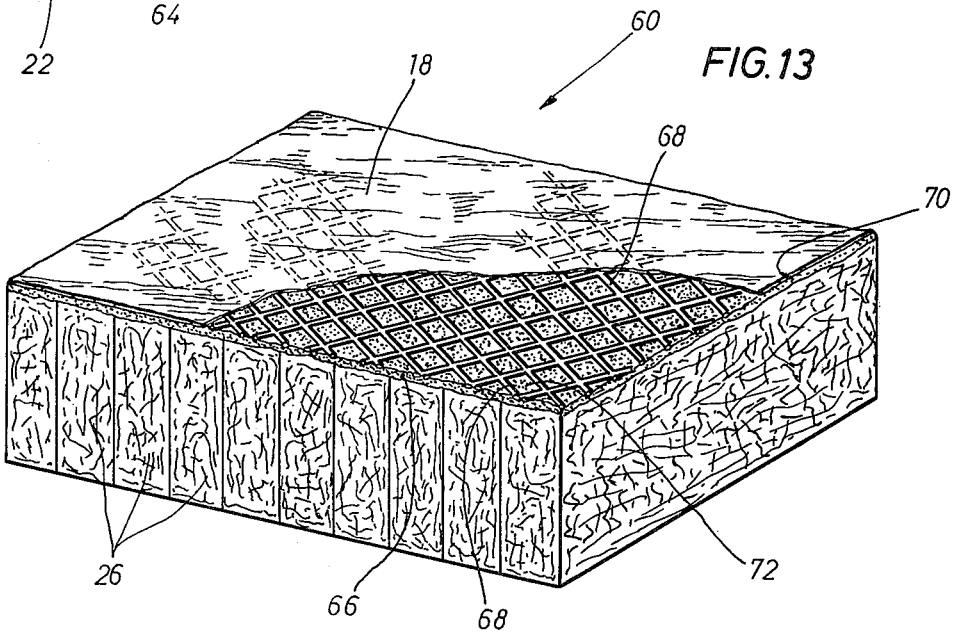
FIG. 13 is a perspective view of another arrangement for a ceramic fiber insulating module for use in practicing the present invention with a portion of the module removed to expose a portion of a substrate.

Overlying the first layer 66 is a second layer 68 comprised of a fiberglass fabric. This fiberglass fabric 68 is cloth-like prior to its being introduced into the substrate 64 and may have a mesh covering a wide variety of geometries or mesh sizes. As may be seen in FIG. 13, the fiberglass fabric preferably extends to the edges of the surface 67.

An outside or third layer 70 of inhibitor/adhesive is applied over the fiberglass fabric 68. This outside layer 70 may not be as thick as the first layer 66 and may take the appearance of a "skin" over the fiberglass fabric with the contour of the fiberglass mesh being visible.

The substrate 64 provides a highly reliable fastening arrangement which maintains the strips 26 in side-by-side relationship during handling of the module 60 as well as after a furnace is constructed in accordance with the present invention. A relatively small amount of corrosion inhibitor/adhesive is required to satisfactorily affix the module 60 to the furnace casing 12. Two strips 22 of corrosion inhibitor/adhesive may be required per module in the construction of a furnace according to this invention. It will be appreciated, of course, that the inside face 16 of the furnace casing 12 may be completely covered with another layer of corrosion inhibitor/adhesive and the module 60 applied in a manner similar to that depicted in FIG. 2 and related text. Moreover, whereas fiberglass fabric is preferred, other fabrics which demonstrate the appropriate temperature resistance, corrosion resistance, and handling characteristics may be appropriate.

If fiberglass material of an open mesh is utilized, it may be found that the fabric 68 does not form a discrete layer in substrate 64. Rather, the fabric 68 may "sink" into the first layer 66 of corrosion inhibitor/adhesive and comprise a portion of this first layer. In such a case, the corrosion inhibitor/adhesive will flow into the interspaces 72 of the mesh to form a substrate having highly desirable structural characteristics.

Whereas several modules have been described for use in a furnace according to the present invention, yet further alternative embodiments are contemplated. For example, a vacuum formed module may be used which is pre-formed into a desired shape; or a module may be utilized which is fashioned from a single albeit large strip of ceramic fiber.

The corrosion inhibitor/adhesive preferably employed in the practice of the present invention is a room temperature vulcanizing silicone composition as noted above. This composition may be applied to the furnace casing or the ceramic fiber insulating module in a number of ways. For example, the material may be painted or sprayed onto the wall or module or may be troweled on in a denser form. In some instances it may be desirable to spray one component of the corrosion inhibitor/adhesive onto the furnace casing and another onto the insulation module such that when the two surfaces are brought into contact, a chemical action may occur, and the corrosion inhibitor/adhesive may be chemically completed or activated by such contact. In any event, any corrosion inhibitor/adhesive should demonstrate the characteristics hereinabove discussed, and a wide variety of such materials may be known now or may come into existence in the future which demonstrate these characteristics.

SUMMARY OF ADVANTAGES AND SCOPE OF THE INVENTION

It will be appreciated that in a high temperature furnace according to the present invention, certain significant advantages are provided.

In particular, in accordance with the present invention it is possible to anaerobically isolate the interior walls of a furnace chamber to provide an impervious barrier in order to prevent corrosive gases from coming into contact with the casing and condensing to form acids destructive to the furnace casing. Metallic fastening hardware is not required to attach the insulation to the furnace. In addition, the present invention permits the construction of furnaces having unusual interior geometries or obstacles. This is particularly advantageous in devices such as oil heaters where pipes spaced approximately six inches or so from the interior of the furnace casing provide obstacles to presently known construction or repair techniques. The present arrangement, in addition, provides a continuous, uninterrupted lining along the interior of the metal furnace casing.

A variety of insulation thicknesses may be utilized in the practice of this invention depending upon the operating temperature of the furnace and upon the thermal efficiency required for the particular furnace. A thickness of insulation may be selected which will provide an external casing temperature of less than 150° F.

Thus, it is apparent that there has been provided, in accordance with the present invention, an industrial furnace that substantially satisfies the objects and advantages set forth above. Although the present invention has been described in conjunction with specific forms thereof, it is evident that many alternatives, modifications, and variations will be apparent to those skilled in the art in light of the foregoing disclosure. For example, vacuum formed modules may be utilized in the construction of a furnace according to this invention. Accordingly, it is intended that all such alternatives, modifications, and variations which fall within the spirit and scope of the invention as defined in the appended claims be embraced thereby.

What is claimed is:

1. A high temperature industrial furnace comprising:
   a metal chamber wall having an inside surface and an outside surface;
   an insulation module positioned over said inside surface of said wall;
   a flexible adhesive intermediate said inside surface of said wall and said module, said flexible adhesive being operable to support said module over said wall and flexibly resist cracking during thermal movement of said wall during operation of said furnace.

2. The furnace of claim 1 wherein said module comprises ceramic fibers.

3. The furnace of claim 2 wherein said module comprises:
   a plurality of side-by-side strips of material composed of insulation fibers, the fibers having no particular orientation but forming a plurality of planes substantially parallel to each other and generally perpendicular to said inside surface of said wall.

4. The furnace of claim 2 wherein said module comprises ceramic fibers vacuum formed into a predetermined shape.

5. The furnace of claim 1 and further comprising a layer of temporary cement on a hot face of said module.

6. The furnace of claim 1 wherein said adhesive comprises a silicone compound.

7. The furnace of claim 1 wherein said flexible adhesive completely covers an area of said inside surface of said wall corresponding to an area of a cold face of said module.

8. The furnace of claim 7 wherein said flexible adhesive is operable as a barrier to inhibit a formation of corrosion on said inside surface of said wall.

9. The furnace of claim 1 and further comprising a fabric embedded in said flexible adhesive.

10. The furnace of claim 9 wherein said fabric is comprised of glass fibers.

11. A high temperature industrial furnace comprising:
   a chamber wall having an inside surface and an outside surface;
   an insulation module positioned over said inside surface of said wall;
   a flexible silicone adhesive compound intermediate said inside surface of said wall and said module, said adhesive compound being operable to support said module during operation of said surface.

12. The furnace of claim 11 wherein said module comprises ceramic fibers.

13. The furnace of claim 12 wherein said module comprises:

a plurality of side-by-side strips of material composed of insulation fibers, the fibers having no particular orientation but forming a plurality of planes substantially parallel to each other and generally perpendicular to said inside surface of said wall.

14. The furnace of claim 12 wherein said module comprises ceramic fibers vacuum formed into a predetermined shape.

15. The furnace of claim 11 and further comprising a layer of temporary cement on a hot face of said module.

16. The furnace of claim 11 wherein said chamber wall is comprised of metal.

17. The furnace of claim 11 wherein said flexible adhesive completely covers an area of said inside surface of said wall corresponding to an area of a cold face of said module.

18. The furnace of claim 17 wherein said flexible adhesive is operable as a barrier to inhibit a formation of corrosion on said inside surface of said wall.

19. The furnace of claim 11 and further comprising a fabric embedded in said flexible adhesive.

20. The furnace of claim 19 wherein said fabric is comprised of glass fibers.

* * * * *